US005341781A

United States Patent [19]

Gerhardt

[11] Patent Number: 5,341,781

[45] Date of Patent: Aug. 30, 1994

[54] REDUCED COMPONENT INTERNAL COMBUSTION ENGINE

[75] Inventor: Todd Gerhardt, Grafton, Wis.

[73] Assignee: Kohler Co., Kohler, Wis.

[21] Appl. No.: 138,793

[22] Filed: Oct. 18, 1993

[51] Int. Cl.[5] ..... F02F 7/00

[52] U.S. Cl. ..... 123/195 R; 123/54.1; 123/54.4

[58] Field of Search ..... 123/55 R, 56 R, 195 R, 123/195 P

[56] References Cited

U.S. PATENT DOCUMENTS

| | | | |
|---|---|---|---|
| 4,129,103 | 12/1978 | Pichl | 123/52 R |
| 4,399,777 | 8/1983 | Hoettels | 123/55 R |
| 4,399,778 | 8/1983 | Ancheta | 123/55 R |
| 4,922,863 | 5/1990 | Adams | 123/52 MC |
| 5,148,782 | 9/1992 | Kramer et al. | 123/195 R |
| 5,195,480 | 3/1993 | Hudson | 123/195 R |
| 5,201,115 | 4/1993 | Inoue | 29/888.01 |
| 5,235,942 | 8/1993 | Olmr | 123/90.27 |

*Primary Examiner*—Noah P. Kamen
*Attorney, Agent, or Firm*—Quarles & Brady

[57] ABSTRACT

An engine block is formed by a single piece lower crankcase and a single piece upper crankcase having abutting surfaces sealed with a gasket. The abutting surfaces have semicircular notches aligned with one another to form a circular opening for a crankshaft. The upper crankcase includes central section from which extends a barrel unit that contains the entire cylinder bore for a piston. An integral housing for the cylinder valves and rocker arms is formed on the barrel unit and an integral intake manifold extends from the housing. Forming the engine block from two primary components reduces the number of joints that require machining and gaskets.

16 Claims, 3 Drawing Sheets

REDUCED COMPONENT INTERNAL COMBUSTION ENGINE

BACKGROUND OF THE INVENTION

The present invention relates to internal combustion engines, and more particularly to the construction of the engine block and intake manifold for such engines.

Internal combustion engines, such as small single and multi-cylinder engines, typically are constructed by bolting together castings of different components. For example, as shown in FIGS. 1A and 1B, a conventional small two cylinder engine 1 has a crankcase 2 with a pair of cylinder heads 4 and 6 attached on either side in a standard V configuration. The combination of the crankcase and one cylinder head forms a cylinder bore for a piston. During the assembly of the cylinder heads 4 and 6 onto the crankcase 2, pistons are inserted within the cylinders formed by components 2, 4 and 6 and attached to a crankshaft located extending through opening 7 within the crankcase 2. After these components have been assembled, a closure plate 9 is bolted to one side of the crankcase 2.

A separate intake manifold 8 is connected between inlet ports on each of the cylinder heads 4 and 6. In the finished engine, a carburetor (not shown) is connected to the inlet manifold 8. In order for the different components of the engine to tightly fit together, complex machining of the abutting surfaces is required. The more components of the engine the greater number of machined surfaces. The components often are made of cast aluminum that are held together by steel bolts. The different thermal expansion coefficients of aluminum and steel induce very high thermal stresses near the component joints when the engine reaches normal operating temperatures. Furthermore, the joints between the components must be properly sealed with gaskets. The joints between the crankcase 2 and the cylinder heads 4 and 6 often are difficult to seal due to high operating temperatures and gas pressures. In addition, each gasketed joint forms a thermal barrier that often creates large temperature gradients within small areas which can lead to distortion of the engine components. Such distortions increase oil consumption which in turn increase pollutants in the engine exhaust.

In addition, the use of bolts to connect components together directs forces through those bolts, that tend to separate the components. This creates discrete areas of extremely high stress, particularly in threads of aluminium components.

SUMMARY OF THE INVENTION

The primary object of the invention is to reduce the number of components that form the block for a small internal combustion engine and thus reduce the number of joints requiring complex machining and gaskets.

This objective is fulfilled by an engine block that includes a single piece lower crankcase that adjoins a single piece upper crankcase. Preferably the upper crankcase is formed as a single casting by a near net shape casting process. The lower crankcase has a generally flat first surface with a substantially semicircular first notch therein. The upper crankcase has a second surface adjoining the first surface of the lower crankcase with the second surface having a semicircular second notch. When the upper crankcase is attached to the lower crankcase the first and second notches align to form an opening for a crankshaft. A cylinder bore for a piston is formed entirely in the upper crankcase and has apertures at one end for receiving a pair of cylinder valves. A housing for a mechanism that actuates the pair of cylinder valves is positioned on the outside of the upper crankcase around the apertures for the cylinder valves.

DETAILED DESCRIPTION OF THE INVENTION

Figure 1B:
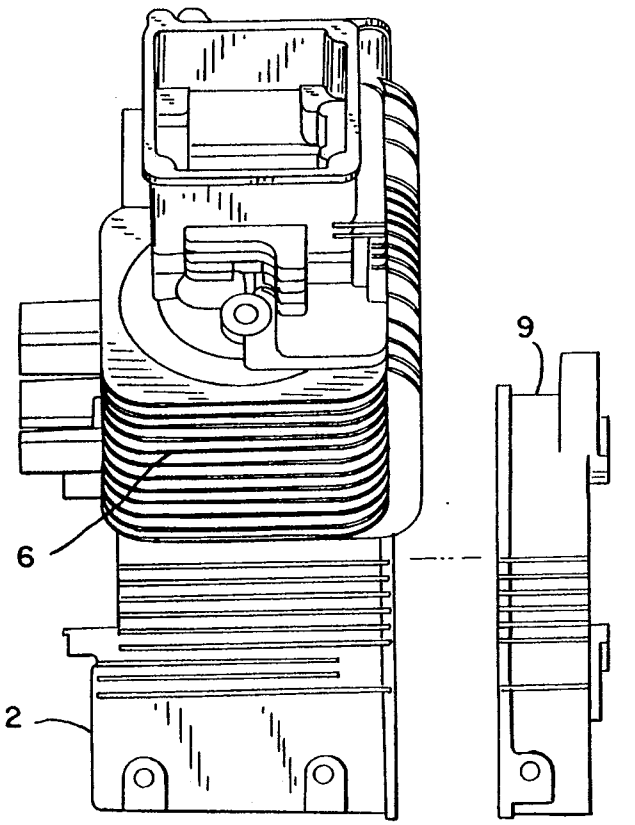
FIG. 1B PRIOR ART
FIGS. 1A and 1B represent exploded views of the crankcase, cylinder header and intake manifold for a typical prior art internal combustion engine.
Figure 1A:
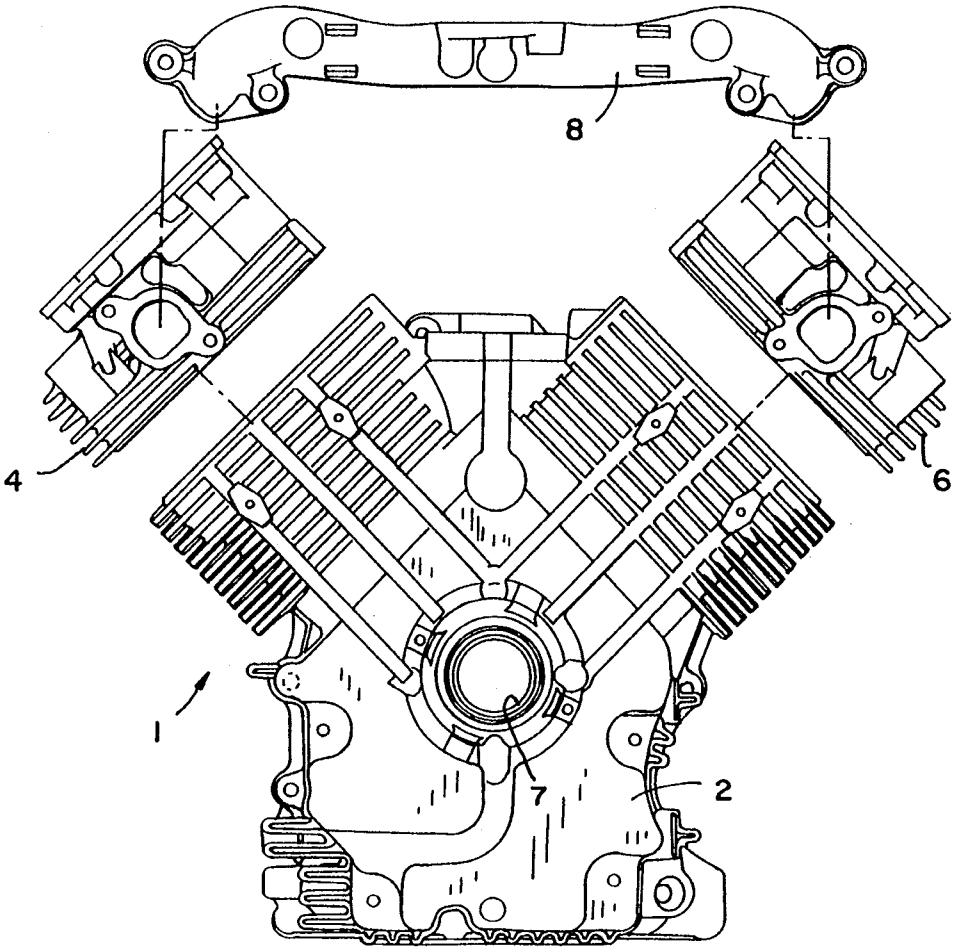
FIG. 1A PRIOR ART
Figure 2:
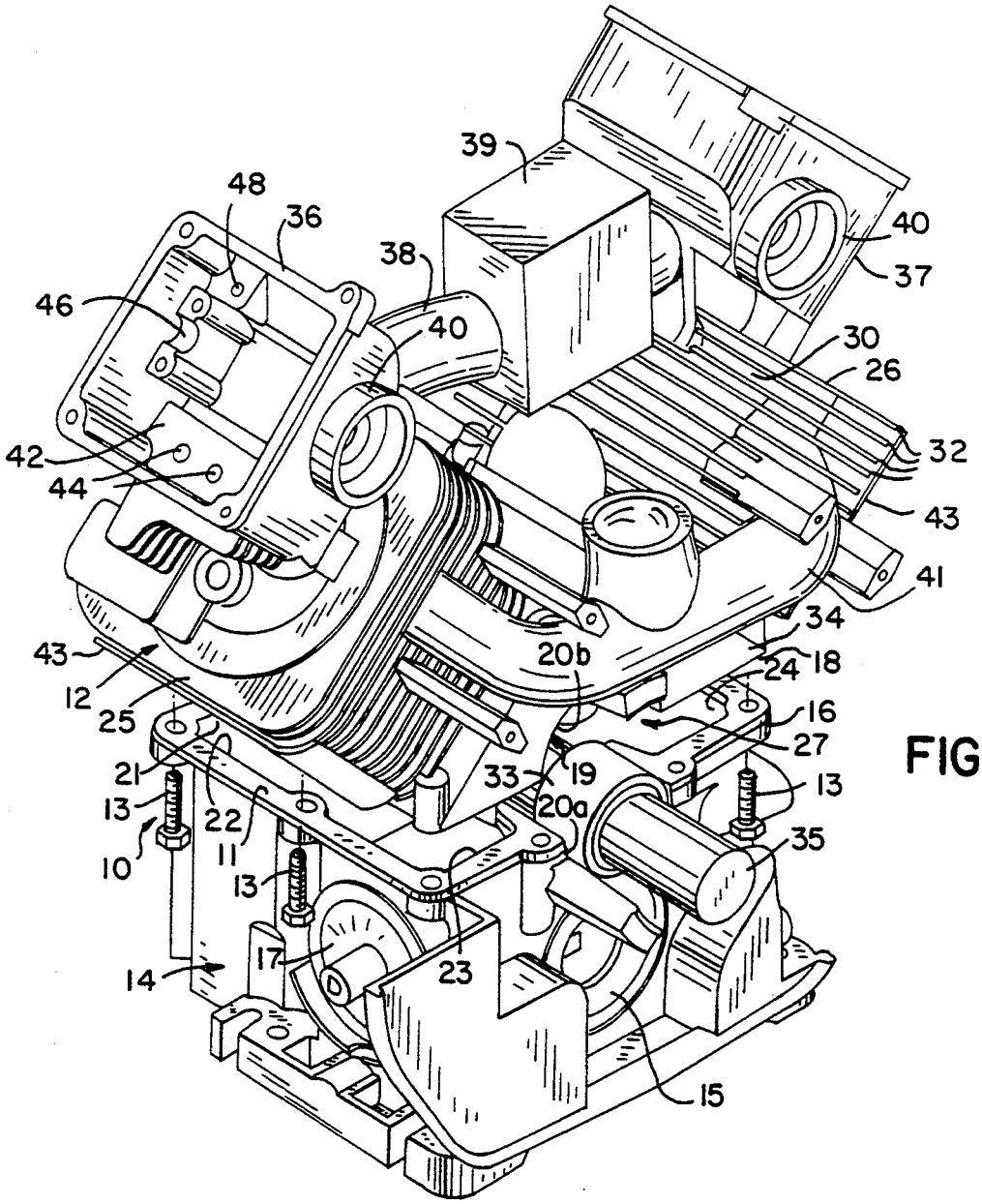
FIG. 2 is an exploded view of a internal combustion engine block according to the present invention.

With reference to FIG. 2, a preferred embodiment of an engine block 10 according to the present invention comprises a single piece upper crankcase 12 and a single piece lower crankcase 14 secured together by bolts 13 with a gasket 11 or RTV-types sealant therebetween. The upper crankcase 12 and lower crankcase 14 are fabricated as single pieces utilizing a near net shape casting process, with the currently preferred process being an expendable pattern casting method. In that method, pieces of foam or wax are glued together make a pattern for casting the respective component. The pattern is coated with a slurry and then sand is compacted around the pattern to form a mold. Molten steel or aluminum is poured into the mold and the foam or wax pattern evaporates, being replaced by the molten metal. Investment casting or disposable core die casting also can be used to fabricate the upper crankcase 12 and lower crankcase 14.

The lower crankcase 14 has four abutting walls 21, 22, 23 and 24, the edges of which are machined to form surface 16 which mates with a corresponding machined surface 18 of the cylinder body. The seam between the two components 12 and 14 extends diametrically through a circular opening 19 in the engine block 10 for crankshaft 35 and bearing 33. Thus half of the crankshaft opening 19 is formed by a semicircular notch **20*a* in wall 23 of the lower crankcase 14. The lower crankcase 14 has an inner chamber 27 which receives the crankshaft 35, and forms a well for lubricating oil. An aperture 15 in wall 23 houses an oil pump that is driven by the crankshaft 35. A conventional oil filter mount 17 is provided on wall 22**.

Figure 3:
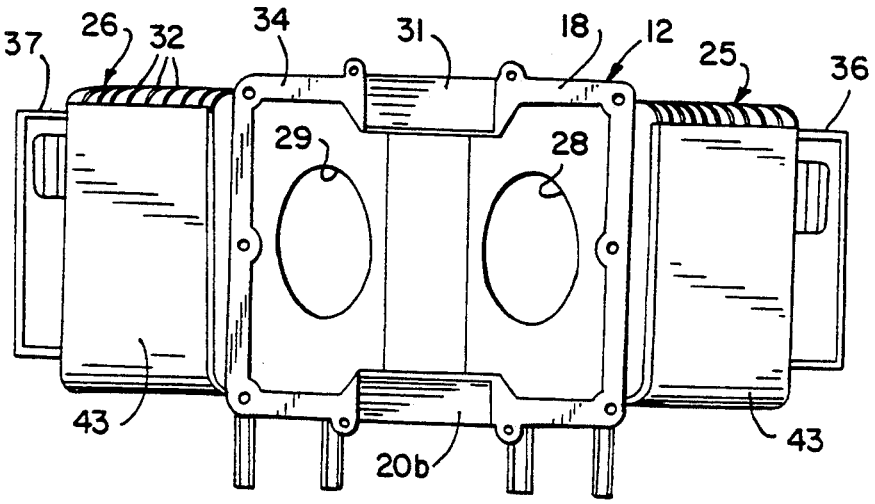
FIG. 3 is a plane view of the bottom surface of the upper crankcase in FIG. 2.

Referring to FIGS. 2 and 3, the upper crankcase 12 has two cylinder barrels 25 and 26, each having a cylinder bore 28 and 29, respectively. As shown in better detail with respect to cylinder barrel 26, both of the cylinder barrels have a body 30 with a plurality of heat fins 32 extending outwardly on all sides of the body. Each cylinder barrel 25 and 26 has an integral baffle 43 on the outer side of the heat fins 32 to direct the flow of air across the fins. The central axes of the cylinder bores 28 and 29 are approximately orthogonal to one another with the two axes meeting at the center axis of the crankshaft 35 to form a V-shaped cylinder configuration.

The two cylinder bores 28 and 29 extend from a central section 34 which forms a cover for the lower crankcase 14. The central section 34 has one edge which is machined to form the mating surface 18 for the upper surface 16 of the lower crankcase. The other half of the crankshaft opening is formed by a semicircular notch 20*b* in the central section 34. When the upper crankcase 12 is assembled onto lower crankcase 14, the axes of curvature for the semicircular notches 20*a* and 20*b* align so that the notches form a circular crankshaft opening 19. As shown in FIG. 3, there is a similar notch 31 that forms another crankshaft opening on the opposite side of the upper crankcase 12. As with the first crankshaft opening 19, this other opening is formed by aligned semicircular notches in the upper crankcase and lower crankcase 14.

At the opposite end of each of the cylinder barrels 25 and 26 from the central section 34 is an integral valve housing 36 and 37 which encloses the intake and exhaust valves for the respective cylinder. The upper crankcase 12 also has an integral intake manifold 38 which provides a conduit for the fuel mixture to flow from a carburetor (not illustrated) attached to plenum 39 through passages in the two valve housings 36 and 37 and into the cylinder bores 28 and 29. An exhaust manifold 41 is connected to each valve housings 36 and 37 to carry the post combustion gases from the respective cylinder bore to a muffler (not shown) The intake and exhaust manifolds 38 and 41 are integral portions of the single piece casting that forms the upper crankcase 12.

The present upper crankcase 12, and in particular the two cylinder barrels 25 and 26, form the entire structure of the two cylinder bores 28 and 29. This is in contrast to conventional engines in which a lower part of the cylinder bore was formed in the crankcase and the upper part by a separate cylinder head. Thus, the present engine block 10 does not require a cylinder gasket to seal a joint between different components that form the cylinder bore, e.g. between the crankcase and cylinder head. The present invention, by utilizing a single casting for the upper crankcase 12 has eliminated the cylinder gasket that was prone to failure. By reducing the number of components, the amount of machining and assembly time also has been reduced. The elimination of component joints held together by bolts reduces the peak component stress because forces are distributed over a continous path rather than through discrete paths formed by the bolts. Minimizing the number of gasket joints improves the heat transfer around the cylinder heads of the engine since the thermal barriers inherent with such gasket joints have been eliminated. The intake manifold 38 also is part of the single piece upper crankcase and does not require the manufacturing step of bolting a separate intake manifold to the top of the engine, nor machining of the joining surfaces.

Figure 4:
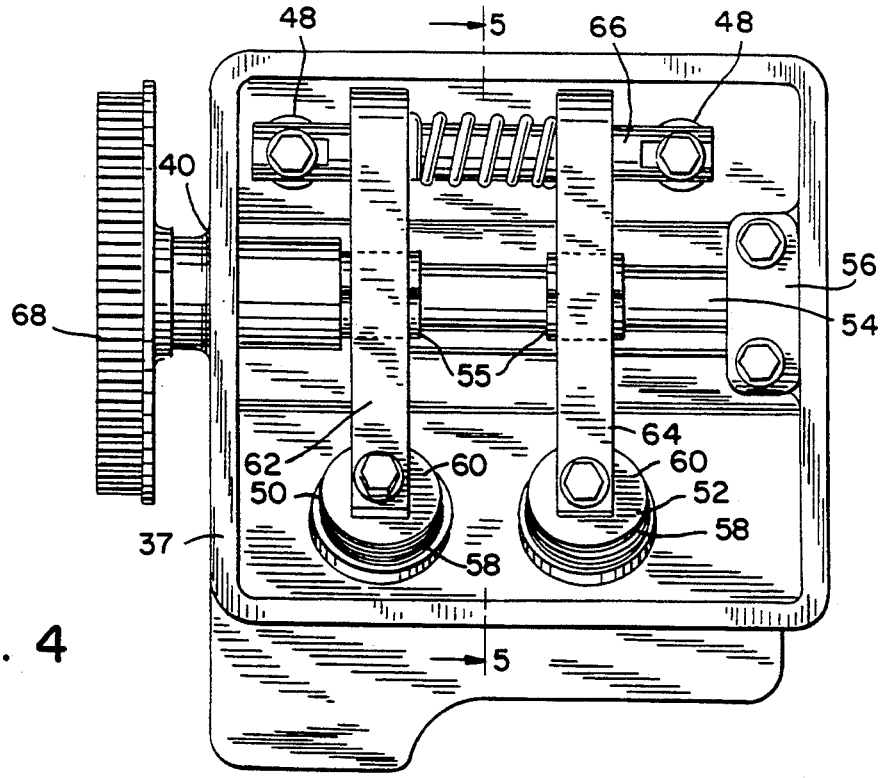
FIG. 4 is a plane view of one of the engine valve mechanisms.
Figure 5:
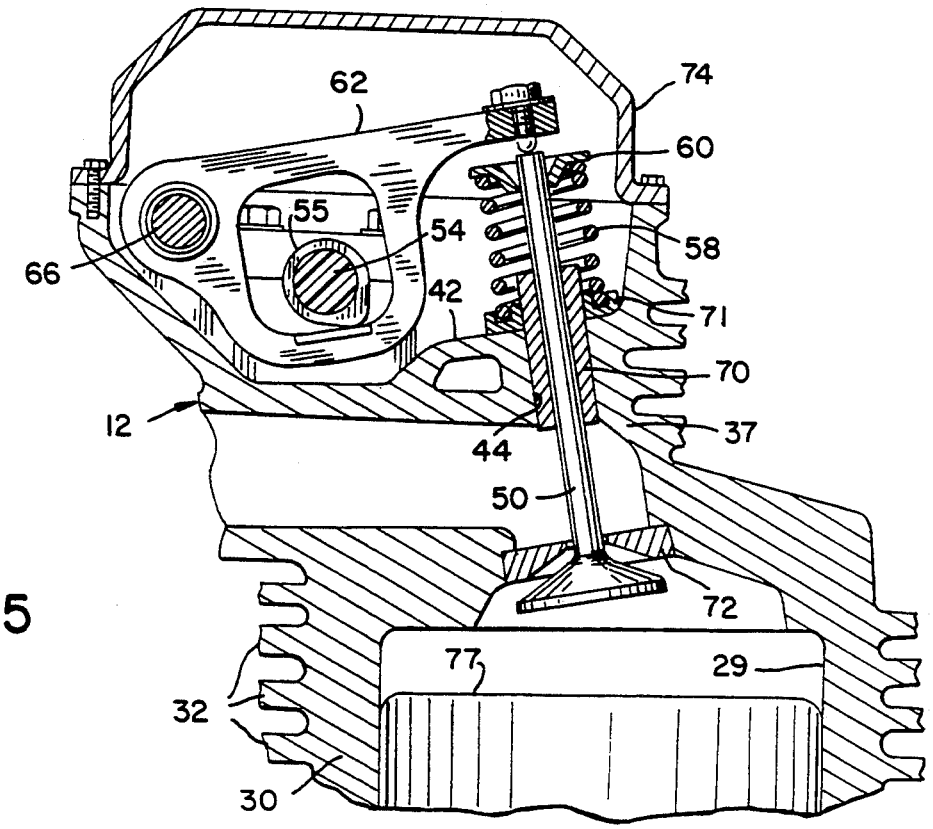
FIG. 5 is a cross-sectional view along line 5—5 of FIG. 4.

Each of the valve housings 36 and 37 contain the components of an overhead cam valve operating mechanism, such as the one described in U.S. Pat. No. 5,235,942 entitled "Cylinder Head Assembly." These valve housings 36 and 37 have mirror image construction with the components of housing 37 shown in FIGS. 4 and 5. An inner surface 42 has two apertures 44 projecting therethrough into the associated cylinder bore 28 or 29. The apertures 44 are sized to receive conventional valve stem guides 70. A pair of cylinder valves 50 and 52 are extend from the corresponding cylinder bore 29 and valve seat 72 upward through apertures 44 and into the valve housing 37. A separate spring 58 and retainer 60 are attached to the end of each of the valve stems with the spring resting in seat 71. One of these valves 50 acts as an intake valve while the other valve 52 is the exhaust valve of the engine cylinder. The piston 77 in cylinder bore 29 is shown in FIG. 5.

A cam shaft 54 is inserted through opening 40 in one wall of the valve housing 36 and terminates at a mounting 46 inside the opposite wall. A cam plate 56 is bolted onto the mounting 46 to hold that end of the cam shaft 54 in place. A pulley 68 is mounted on the external end of the cam shaft 54 that extends through opening 40 in the valve housing 36. A belt (not shown) extends around each of the cam shaft pulleys 68 and around a pulley mounted on the portion of the crankshaft 35 that extends through the engine block opening 19 formed by notches 20*a* and 20*b*. The belt and pulley arrangement provides a drive mechanism for the cam shafts 54. A pair of rocker arms 62 and 64 are attached to a shaft 66 that is bolted through an apertures 48. The rocker arms 62 and 64 are actuated by cams 55 on the cam shaft 54 to engage the valve stems thereby opening and closing the cylinder valves 50 and 52 at the proper moments in the combustion cycle. A cover 74 extends over the valve housing 37 and is bolted thereto.

Although the present invention has been described in the context of a two cylinder engine, the concepts are equally applicable to engines having a single cylinder or more than two cylinders. In addition, the inventive concepts can be applied to gasoline, diesel and liquid petroleum engines.

I claim:

1. An engine block for an internal combustion engine comprising:

a single piece lower crankcase having flat first surface with a substantially semicircular first notch;

a single piece upper crankcase having a second surface adjoining the first surface of said lower crankcase with the second surface having a semicircular second notch aligned with the first notch to form an opening for receiving a crankshaft, said upper crankcase containing an entire cylinder bore for a piston, apertures at one end of the cylinder bore for receiving stems of a pair of cylinder valves, and a housing for a mechanism that actuates the pair of cylinder valves; and means for securing said upper crankcase to said lower crankcase with the first and second surfaces adjoining each other.

2. The engine block as recited in claim 1 wherein said upper crankcase further includes an integral intake manifold connected to the housing to carry a fuel mixture from a carburetor to the cylinder bore.

3. The engine block as recited in claim 1 wherein said upper crankcase further includes an integral exhaust manifold to carry post combustion gases from the cylinder bore.

4. The engine block as recited in claim 1 wherein said upper crankcase is formed by lost material casting.

5. The engine block as recited in claim 1 further comprising two cylinder valves extending from the cylinder bore into the housing through the apertures in the upper crankcase, a cam shaft passing through an aperture in the housing, and two rocker arms engaging the cam shaft and the two cylinder valves.

6. The engine block as recited in claim 1 wherein the first surface is formed by edges of four abutting walls of said lower crankcase and wherein the first notch is located in an edge of one of the walls.

7. An engine block for an internal combustion engine comprising:

a single piece lower crankcase with four walls which combine to form a first surface, and one of the walls having a semicircular first notch in the first surface;

a single piece upper crankcase having central section from which two barrel units extend, the central section having a second surface mated with the first surface of said lower crankcase and having a semicircular second notch aligned with the first notch to form a circular opening, each barrel unit containing an entire cylinder bore for a piston which cylinder bore opens into the central section, said upper crankcase also having a separate housing on each barrel unit; and means for securing said upper crankcase to said lower crankcase with the first and second surfaces adjoining each other.

8. The engine block as recited in claim 7 wherein each of the barrel units of the upper crankcase has a plurality of outwardly projecting fins.

9. The engine block as recited in claim 7 wherein each of the barrel units of the upper crankcase has a plurality of outwardly projecting fins with a baffle extending across edges of the plurality of outwardly projecting fins.

10. The engine block as recited in claim 7 wherein the barrels of the upper crankcase extend from the central section in a V configuration.

11. The engine block as recited in claim 7 wherein said upper crankcase further includes an integral intake manifold connected to each barrel unit to carry a fuel mixture from a carburetor to the cylinder bores.

12. The engine block as recited in claim 7 wherein said upper crankcase further includes an integral intake manifold connected to the two barrel units with the intake manifold having a plenum for coupling to a carburetor.

13. The engine block as recited in claim 7 wherein said upper crankcase further includes an integral exhaust manifold connected to the two barrel units to carry post combustion gases from the cylinder bore.

14. The engine block as recited in claim 7 further comprising a crankshaft within said lower crankcase and projecting through the opening formed by the first and second notches; and a pair of pistons each located in the cylinder bore of a different barrel unit and attached to the crankshaft.

15. The engine block as recited in claim 7 further comprising:

a first pair of cylinder valves extending from one cylinder bore into one housing through the apertures in the upper crankcase;

a second pair of cylinder valves extending from another cylinder bore into another housing through the apertures in the upper crankcase; and wherein each housing includes a cam shaft passing through an aperture in the housing, and two rocker arms engaging the cam shaft and two cylinder valves.

16. The engine block as recited in claim 7 wherein said upper crankcase is formed by lost material casting.

* * * * *